US005958511A

United States Patent [19]

Dolan

[11] Patent Number: 5,958,511

[45] Date of Patent: Sep. 28, 1999

[54] PROCESS FOR TOUCHING UP PRETREATED METAL SURFACES

[75] Inventor: Shawn E. Dolan, Sterling Heights, Mich.

[73] Assignee: Henkel Corporation, Plymouth Meeting, Pa.

[21] Appl. No.: 08/837,503

[22] Filed: Apr. 18, 1997

[51] Int. Cl.[6] ..... B05D 7/14

[52] U.S. Cl. ..... 427/258; 427/287; 427/384

[58] Field of Search ..... 427/258, 287, 427/384

[56] References Cited

U.S. PATENT DOCUMENTS 5,427,632 6/1995 Dolan ..... 148/259
5,449,415 9/1995 Dolan ..... 148/259

FOREIGN PATENT DOCUMENTS 9504169 2/1995 WIPO .
9607772 3/1996 WIPO .

*Primary Examiner*—Erma Cameron
*Attorney, Agent, or Firm*—Ernest G. Szoke; Wayne C. Jaeschke; Norvell E. Wisdom, Jr.

[57] ABSTRACT

Defects in an initial protective coating, particularly a conversion coating, on a metal substrate can be touched up so as to at least equal the original coating in corrosion protection by use of a dry-in-place aqueous acidic liquid comprising:

(A) fluorometallate anions;

(B) divalent or tetravalent cations of elements selected from the group consisting of cobalt, magnesium, manganese, zinc, nickel, tin, copper, zirconium, iron, and strontium;

(C) a component selected from the group consisting of phosphorus-containing inorganic oxyanions and phosphonate anions; and (D) a component of water-soluble and/or -dispersible organic polymers and/or polymer-forming resins.

20 Claims, No Drawings

PROCESS FOR TOUCHING UP PRETREATED METAL SURFACES

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to processes for treating a metal surface on which a protective coating has previously been formed and remains in place, with its protective qualities intact, on one part of the surface but is totally or partially absent from, or is present only in a damaged condition over, one or more other parts of the surface, so that its protective value in these areas of at least partial damage or absence has been diminished. (Usually the absence or damage of the initial protective coating has been unintentional and has occurred as a result of such events as imperfectly uniform formation of the initial protective coating, mechanical damage of the initial protective coating, spotty exposure of the initially coated surface to solvents for the initial protective coating, or the like.) Particularly if the surface in question is large and the damaged area(s) relatively small, it is often more economical to attempt to create or restore the full protective value of the original coating primarily in only the absent or damaged areas, without completely recoating the object. Such a process is generally known in the art, and will be briefly described herein, as "touching up" the surface in question. This invention is particularly well suited to touching up surfaces in which the original protective coating is a conversion coating initially formed on a primary metal surface, more particularly a primary metal surface consisting predominantly of iron, aluminum, and/or zinc.

A variety of materials have been taught in the prior art for the general purposes of the present invention, but most of if not all of them contain hexavalent chromium, which is environmentally undesirable.

One object of this invention is to avoid any substantial use of hexavalent chromium and other materials such as ferricyanide that have been identified as environmentally damaging. Other concurrent or alternative objects are to achieve at least as good protective qualities in the touched up areas as in those parts of the touched up surfaces where the initial protective coating is present and undamaged; to avoid any damage to the protective coating from contacting it with the touching up composition; and to provide an economical touching up process. Other objects will be apparent to those skilled in the art from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are all by weight or mass; the term "paint" includes all similar materials that may be described by more specialized terms such as "varnish", "lacquer", "shellac", "base coat", "top coat", and the like; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, or of generation in situ within a combination by one or more chemical reactions, as noted in the description, between other material(s) newly added to the combination and material(s) already present in the combination, and does not necessarily preclude other unspecified chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to one of the objects of the invention); any definition of an acronym or other type of abbreviation applies, without the need for repetition of the definition, to all subsequent uses of the same abbreviation and applies, mutatis mutandis, to grammatical variations of the original meaning and abbreviation; and the term "mole" and its grammatical variations may be applied to elemental, ionic, and any other chemical species defined by number and type of atoms present, as well as to compounds with well defined molecules.

BRIEF SUMMARY OF THE INVENTION

It has been found that excellent touching up quality, particularly for corrosion resistance in combination with a conversion coating, can be achieved by (I) covering the areas to be touched up with a layer of a liquid composition that comprises, preferably consists essentially of, or more preferably consists of, water and:

(A) a component of fluorometallate anions, each of said anions consisting of (i) at least four fluorine atoms, (ii) at least one atom of an element selected from the group consisting of titanium, zirconium, hafnium, silicon, aluminum, and boron, and, optionally, one or both of (iii) at least one ionizable hydrogen atom, and (iv) at least one oxygen atom; preferably the anions are fluorotitanate (i.e., $TiF_6^{-2}$) or fluorozirconate (i.e., $ZrF_6^{-2}$), most preferably fluorotitanate;

(B) a component of divalent or tetravalent cations of elements selected from the group consisting of cobalt, magnesium, manganese, zinc, nickel, tin, copper, zirconium, iron, and strontium; preferably, with increasing preference in the order given, at least 60, 70, 80, 90, 95, or 99% by weight of the total of component (B) consists of cobalt, nickel, manganese, or magnesium, more preferably of manganese, cobalt, or nickel, most preferably of manganese; independently, the ratio of the total number of cations of this component to the total number of anions of component (A) preferably is at least, with increasing preference in the order given, 0.20:1.0, 0.33:1.0, 0.40:1.0, 0.60:1.0, 0.70:1.0, 0.80:1.0, 0.90:1.0, 1.00:1.0, or 1.10:1.0 and independently preferably is not more than, with increasing preference in the order given, 3:1.0, 2.5:1.0, 2.1:1.0, 1.8:1.0, 1.6:1.0, 1.4:1.0, or 1.20:1.0;

(C) a component of phosphorus-containing inorganic oxyanions and/or phosphonate anions; and (D) a component of water-soluble and/or -dispersible organic polymers and/or polymer-forming resins, preferably in an amount such that the ratio of the solids content of the organic polymers and polymer-forming resins in the composition to the content of component (A) is at least, with increasing preference in the order given, 0.2:1.0, 0.5:1.0, 0.75:1.0, 0.90:1.0, 1.05:1.0, 1.10:1.0, 1.15:1.0, or 1.20:1.0 and independently preferably is not more than, with increasing preference in the order given, 3.0:1.0, 2.6:1.0, 2.3:1.0, 2.0:1.0, 1.7:1.0, 1.5:1.0, or 1.3:1.0;

and, optionally, one or more of the following components:

(E) an acidifying component that is not part of any of the previously recited components;

(F) a component of dissolved oxidizing agent that is not part of any of the previously recited components, preferably a peroxy compound, more preferably hydrogen peroxide;

(G) a component selected from dissolved or dispersed complexes, stabilized against settling, that are not part of any of the previously recited components, said complexes resulting from reaction between (1) a material selected from fluorometallate anions, each of said anions consisting of (1. 1) at least four fluorine atoms, (1.2) at least one atom of an element selected from the group consisting of titanium, zirconium, hafnium, silicon, aluminum, and boron, and, optionally, one or both of (1.3) ionizable hydrogen atoms and (1.4) one or more oxygen atoms and (2) one or more materials selected from the group consisting of metallic and metalloid elements and the oxides, hydroxides, and carbonates of these metallic or metalloid elements, said reaction producing a reaction product that is not part of any of the previously recited components; preferably this component results from reaction of silica or of vanadium(V) oxide as reactant (2); and (H) a viscosity increasing component that is not part of any of the previously recited components, and then (II) drying into place over the surface the liquid layer formed in step (I).

It should be understood that the components listed need not necessarily all be provided by separate chemicals. For example, it is preferred that the fluorometallate anions and phosphorous containing anions both be added in the form of the corresponding acids, thereby also providing at least some, and usually all, of acidifying component (E).

Various embodiments of the invention include processes for treating surfaces as described above, optionally in combination with other process steps that may be conventional per se, such as precleaning, rinsing, and subsequent further protective coatings over those formed according to the invention, and articles of manufacture including surfaces treated according to a process of the invention.

DETAILED DESCRIPTION OF THE INVENTION

For a variety of reasons, it is preferred that compositions used according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: hexavalent chromium; ferricyanide; ferrocyanide; sulfates and sulfuric acid; anions containing molybdenum or tungsten; alkali metal and ammonium cations; pyrazole compounds; sugars; gluconic acid and its salts; glycerine; α-glucoheptanoic acid and its salts; and myoinositol phosphate esters and salts thereof.

Component (C) as defined above is to be understood as including all of the following inorganic acids and their salts that may be present in the composition: hypophosphorous acid ($H_3PO_2$), orthophosphorous acid ($H_3PO_3$), pyrophosphoric acid ($H_4P_2O_7$), orthophosphoric acid ($H_3PO_4$), tripolyphosphoric acid ($H_5P_3O_{10}$), and further condensed phosphoric acids having the formula $H_{x+2}P_xO_{3\,x+1}$, where x is a positive integer greater than 3. Component (C) also includes all phosphonic acids and their salts.

Generally, inorganic phosphates, particularly orthophosphates, phosphites, hypophosphites, and/or pyrophosphates, especially orthophosphates, are preferred for component (C) because they are more economical. Phosphonates are also suitable and may be advantageous for use with very hard water, because the phosphonates are more effective chelating agents for calcium ions. Acids and their salts in which phosphorous has a valence less than five may be less stable than the others to oxidizing agents and are less preferred in compositions according to the invention that are to contain oxidizing agents.

Component (D) is preferably selected from the group consisting of epoxy resins, aminoplast (i.e., melamine-formaldehyde and urea-formaldehyde) resins, tannins, phenolformaldehyde resins, and polymers of vinyl phenol with sufficient amounts of alkyl- and substituted alkylaminomethyl substituents on the phenolic rings to render the polymer water soluble or dispersible. More preferably, component (D) is selected from epoxy resins and/or, most preferably only from, polymers and/or copolymers of one or more y-(N—$R^1$—N—$R^2$-aminomethyl)-4-hydroxystyrenes, where y=2, 3, 5, or 6, $R^1$ represents an alkyl group containing from 1 to 4 carbon atoms, preferably a methyl group, and $R^2$ represents a substituent group conforming to the general formula $H(CHOH)_nCH_2$—, where n is an integer from 1 to 7, preferably from 3 to 5. The average molecular weight of these polymers preferably is within the range from 700 to 70,000, or more preferably from 3,000 to 20,000.

The pH of a composition used according to the invention preferably is at least, with increasing preference in the order given, 0.5, 1.0, 1.3, 1.5, 1.7, 1.90, 2.00, 2.10, 2.20, 2.30, or 2.40 and independently preferably is not more than, with increasing preference in the order given, 5.0, 4.5, 4.0, 3.7, 3.5, 3.3, 3.1, 2.9, 2.70, or 2.60.

If used, component (F) preferably is present in a working composition according to this invention in an amount sufficient to provide a concentration of oxidizing equivalents per liter of composition that is equal to that of a composition containing from 0.5 to 15, or more preferably from 1.0 to 9.0% of hydrogen peroxide. (The term "oxidizing equivalent" as used herein is to be understood as equal to the number of grams of oxidizing agent divided by the equivalent weight in grams of the oxidizing agent. The equivalent weight of the oxidizing agent is the gram molecular weight of the agent divided by the change in valency of all atoms in the molecule which change valence when the molecule acts as an oxidizing agent; usually, this is only one element, such as oxygen in hydrogen peroxide.)

The term "stabilized against settling" in the description of component (G) above means that the composition containing the material does not suffer any visually detectable settling or separation into distinct liquid phases when stored for a period of 100, or more preferably 1000, hours at 25° C.

Materials for component (G) may be prepared by adding one or more metallic and/or metalloid elements or their oxides, hydroxides, and/or carbonates to an aqueous composition containing one or more substances that, if left unreacted, could become part of component (A). A spontaneous chemical reaction normally ensues, converting the added element, oxide, hydroxide, or carbonate into a soluble species. The reaction to form this soluble species can be accelerated by use of heat and stirring or other agitation of the composition. The formation of the soluble species is also aided by the presence in the composition of suitable complexing ligands, such as peroxide and fluoride. Preferably the amount of component (G) when used in a concentrate composition is not greater than that formed by addition, with increasing preference in the order given, of up to 50, 20, 12, 8, 5, or 4 parts per thousand, based on the ultimate total mass of the concentrate composition, of the metallic or metalloid element or its stoichiometric equivalent in an oxide, hydroxide, or carbonate, to the concentrate composition. Independently, the amount of component (G) when used in a concentrate composition preferably is at least as great as that formed by addition, with increasing preference in the order given, of at least 0.1, 0.20, 0.50, or 1.0 parts per thousand, based on the ultimate total mass of the concentrate composition, of the metallic or metalloid element or its stoichiometric equivalent in an oxide, hydroxide, or carbonate, to the concentrate composition.

The effectiveness of a treatment according to the invention appears to depend predominantly on the total amounts of the active ingredients that are dried in place on each unit area of the treated surface, and on the nature and ratios of the active ingredients to one another, rather than on the concentration of the acidic aqueous composition used, and the speed of drying has not been observed to have any technical effect on the invention, although it may well be important for economic reasons. If practical in view of the size of the object treated and of the size of the areas touched up, drying may be speeded by placement in an oven, use of radiative or microwave heating, or the like. If speed of treatment is desired, but placing the entire object in an oven is inconvenient, a portable source of hot air or radiation may be used in the touched up area(s) only. If ample time is available at acceptable economic cost, a liquid film applied according to this invention may simply be allowed to dry spontaneously in the ambient atmosphere with equally good results insofar as the protective quality of the coating is concerned. Suitable methods for each circumstance will be readily apparent to those skilled in the art.

As a general guide, it is normally preferable, independently for each concentration and ratio stated and with increasing preference in the order given for each number sequence, if the working composition has: a concentration of at least 0.010, 0.020, 0.030, 0.040, 0.045, 0.050, 0.055, or 0.060 gram moles per kilogram of total composition (hereinafter usually abbreviated as "M/kg") of fluorometallate anions component (A); at least 0.015, 0.025, 0.030, 0.035, 0.040, 0.045, 0.050, 0.055, 0.060, 0.064, or 0.067 M/kg of phosphorus from component (C); a ratio of the concentration of phosphorus from component (C) in M/kg to the concentration of fluorometallate anions from component (A) in M/kg that is at least 0.12:1.0, 0.25:1.0, 0.35:1.0, 0.45:1.0, 0.55:1.0, 0.65:1.0, 0.75:1.0, 0.85:1.0, 0.95:1.0, 1.00:1.0, 1.05:1.0, or 1.10:1.0 and independently preferably is not more than 5.0:1.0, 4.0:1.0, 3.5:1.0, 3.0:1.0, 2.5:1.0, 2.0:1.0, 1.8:1.0, 1.6:1.0, 1.50:1.0, 1.40:1.0, 1.30:1.0, 1.25:1.0, 1.20:1.0, or 1.15:1.0; and at least 0.10, 0.20, 0.30, 0.40, 0.60, 0.80, 1.00, or 1.20% of solids from component (D). Working compositions containing up to at least five times these amounts of active ingredients are also fully satisfactory to use. Dilute compositions, within these preferred ranges, that include the necessary active ingredients (A) through (D) only may have inadequate viscosity to be self-supporting in the desired thickness for touching up areas that can not be placed in a substantially horizontal position during treatment and drying; if so, one of the materials known in the art, such as natural gums, synthetic polymers, colloidal solids, or the like should be used as optional component (H), as generally known in the art, unless sufficient viscosity is provided by one or more of other optional components of the composition.

A working composition according to the invention may be applied to a metal workpiece and dried thereon by any convenient method, several of which will be readily apparent to those skilled in the art. For example, coating the metal with a liquid film may be accomplished by immersing the surface in a container of the liquid composition, spraying the composition on the surface, coating the surface by passing it between upper and lower rollers with the lower roller immersed in a container of the liquid composition, contact with a brush or felt saturated with the liquid treatment composition, and the like, or by a mixture of methods. Excessive amounts of the liquid composition that might otherwise remain on the surface prior to drying may be removed before drying by any convenient method, such as drainage under the influence of gravity, passing between rolls, and the like. The temperature during application of the liquid composition may be any temperature within the liquid range of the composition, although for convenience and economy in application, normal room temperature, i.e., from 20–27° C., is usually preferred.

Preferably the amount of composition applied in a process according to this invention is chosen so as to result, after drying into place, in at least as good corrosion resistance for the parts of the surface treated according to the invention as in the parts of the same surface where the initial protective coating is present and a process according to the invention has not been applied. Ordinarily, for most common protective phosphate and chromate conversion coatings as initial protective coatings, such protection will be achieved if the total add-on mass (after drying) of the coating applied in a process according to the invention is at least, with increasing preference in the order given, 0.05, 0.10, 0.15, 0.20, 0.25, 0.30, 0.35, 0.40, 0.45, 0.50, 0.55, or 0.60 grams per square meter of surface coated (hereinafter usually abbreviated as "$g/m^2$"). Independently, at least equal corrosion resistance ordinarily will be achieved even if the add-on mass is not, and therefore for reasons of economy the add-on mass preferably is not, greater than, with increasing preference in the order given, 4.0, 3.0, 2.0, 1.7, 1.4, 1.2, 1.0, 0.90, 0.85, 0.80, or 0.75 $g/m^2$.

The add-on mass of the protective film formed by a process according to the invention may be conveniently monitored and controlled by measuring the add-on weight or mass of the metal atoms in the anions of component (A) as defined above, except in the unusual instances when the initial protective coating and/or the underlying metal substrate contains the same metal element(s). The amount of these metal atoms may be measured by any of several conventional analytical techniques known to those skilled in the art. The most reliable measurements generally involve dissolving the coating from a known area of coated substrate and determining the content of the metal of interest in the resulting solution. The total add-on mass can then be calculated from the known relationship between the amount of the metal in component (A) and the total mass of the part of the total composition that remains after drying. However, this method is often impractical for use with this invention, because the area touched up is not always precisely defined. A more practical alternative is generally provided by small area X-ray spectrographs that, after conventional calibration, directly measure the amount(s) per unit area of individual metallic element(s) present in a coating, free from almost all interferences except the same elements present in other coatings on, or in a thin layer near the surface of, the underlying metal surface itself.

In many instances sufficiently precise control of the amount of coating used can be determined visually from the color of the area coated, because most preferred compositions for use according to the invention are fairly strongly colored. Unless the surface to be treated happens to be the same or a similar color, the amount of active ingredients can therefore be estimated by the intensity of the color of the liquid film formed in a process according to the invention.

Preferably, the surface to be treated according to the invention is first cleaned of any contaminants, particularly organic contaminants and foreign metal fines and/or inclusions. Such cleaning may be accomplished by methods known to those skilled in the art and adapted to the particular type of substrate to be treated. For example, for galvanized steel surfaces, the substrate is most preferably cleaned with a conventional hot alkaline cleaner, then rinsed with hot water and dried. For aluminum, the surface to be treated most preferably is first contacted with a conventional hot alkaline cleaner, then rinsed in hot water, then, optionally, contacted with a neutralizing acid rinse and/or deoxidized, before being contacted with an acid aqueous composition as described above. Ordinarily, cleaning methods suitable for the underlying metals will also be satisfactory for any part of the initial protective coating that is also coated in a process according to the invention, but care should be taken to choose a cleaning method and composition that do not themselves damage the protective qualities of the initial protective coating in areas that are not to be touched up. If the initial protective coating is thick enough, the surface can be satisfactorily cleaned by physically abrading, as with sandpaper or another coated abrasive, the area(s) to be touched up and any desired overlap zone, where the initial protective coating is still in place, around the damaged areas to be touched up, then removing the swarf by blowing, brushing, rinsing, or attachment to a cleaning tool, such as a moist cloth.

Usually, it is preferable, as a precaution during a touch up process according to the invention, to apply the composition used for touching up not only to obviously bare metal or obviously damaged areas of the initial protective coating, but also over a transition or overlap zone of apparently undamaged initial protective coating adjacent to such areas that obviously need touching up. With increasing preference in the order given, such a transition zone has a width that is at least 0.2, 0.5, 0.7, 1.0, 1.5, or 2.0 millimeters and independently preferably, primarily for reasons of economy, is not more than, with increasing preference in the order given, 25, 20, 15, 10, 8, 6, 5, or 3 millimeters.

Virtually any kind of initial protective coating can be touched up effectively for many purposes by a process according to this invention. In particular, but without limitation, conversion coatings produced on underlying metal according to the teachings of any one of the following U.S. Patents, the disclosures of all of which, except to any extent that they may be inconsistent with any explicit statement herein, are hereby incorporated herein by reference, may be effectively touched up by a process according to this invention: U.S. Pat. No. 5,595,611 of Jan. 21, 1997 to Boulos et al.; U.S. Pat. No. 5,551,994 of Sep. 3, 1996 to Schriever; U.S. Pat. No. 5,534,082 of Jul. 9, 1996 to Dollman et al.; U.S. Pat. No. 5,507,084 of Apr. 16, 1996 to Ogino et al.; U.S. Pat. No. 5,498,759 of Mar. 12, 1996 to Nakada et al.; U.S. Pat. No. 5,498,300 of Mar. 12, 1996 to Aoki et al.; U.S. Pat. No. 5,487,949 of Jan. 30, 1996 to Schriever, U.S. Pat. No. 5,472,524 of Dec. 5, 1995; U.S. Pat. No. 5,472,522 of Dec. 5, 1995 to Kawaguchi et al; U.S. Pat. No. 5,452,884 of Oct. 3, 1995; U.S. Pat. No. 5,451,271 of Sep. 19, 1995 to Yoshida et al.; U.S. Pat. No. 5,449,415 of Sep. 19, 1995 to Dolan; U.S. Pat. No. 5,449,414 of Sep. 12, 1995 to Dolan; U.S. Pat. No. 5,427,632 of Jun. 27, 1995 to Dolan; U.S. Pat. No. 5,415,687 of May 16, 1995 to Schriever; U.S. Pat. No. 5,411,606 of May 2, 1995 to Schriever; U.S. Pat. No. 5,399,209 of Mar. 21, 1995 to Suda et al.; U.S. Pat. No. 5,395,655 of Mar. 7, 1995 to Kazuyuki et al.; U.S. Pat. No. 5,391,239 of Feb. 21, 1995 to Boulos; U.S. Pat. No. 5,378,392 of Jan. 3, 1995 to Miller et al.; U.S. Pat. No. 5,366,567 of Nov. 22, 1994 to Ogino et al.; U.S. Pat. No. 5,356,490 of Oct. 18, 1994 to Dolan et al.; U.S. Pat. No. 5,342,556 of Aug. 30, 1994 to Dolan; U.S. Pat. No. 5,318,640 of Jun. 7, 1994 to Ishii et al.; U.S. Pat. No. 5,298,092 of Mar. 29, 1994 to Schriever; U.S. Pat. No. 5,281,282 of Jan. 25, 1994 to Dolan et al.; U.S. Pat. No. 5,268,042 of Dec. 7, 1993 to Carlson; U.S. Pat. No. 5,261,973 of Nov. 16, 1993 to Sienkowski et al.; U.S. Pat. No. 5,242,714 of Sep. 7, 1993 to Steele et al.; U.S. Pat. No. 5,143, 562 of Sep. 1, 1992 to Boulos; U.S. Pat. No. 5,141,575 of Aug. 25, 1992 to Yoshitake et al.; U.S. Pat. No. 5,125,989 of Jun. 30, 1992 to Hallman; U.S. Pat. No. 5,091,023 of Feb. 25, 1992 to Saeki et al.; U.S. Pat. No. 5,089,064 of Feb. 18, 1992 to Reghi; U.S. Pat. No. 5,082,511 of Jun. 21, 1992 to Farina et al.; U.S. Pat. No. 5,073,196 of Dec. 17, 1991; U.S. Pat. No. 5,045,130 of Sep. 3, 1991 to Gosset et al.; U.S. Pat. No. 5,000,799 of Mar. 19, 1991 to Miyawaki; U.S. Pat. No. 4,992,196 of Feb. 13, 1991 to Hallman; U.S. Pat. No. 4,985,087 of Jan. 15, 1992 to Mori et al.; U.S. Pat. No. 4,966,634 of Oct. 30, 1990 to Saeki et al.; U.S. Pat. No. 4,961,794 of Oct. 9, 1990 to Miyamoto et al.; U.S. Pat. No. 4,956,027 of Sep. 11, 1990 to Saeki et al.; U.S. Pat. No. 4,927,472 of May 22, 1990 to Matsushima et al.; U.S. Pat. No. 4,880,476 of Nov. 14, 1989 to Matsuda et al.; U.S. Pat. No. 4,874,480 of Oct. 17, 1989 to Sonoda et al.; U.S. Pat. No. 4,865,653 of Sep. 12, 1989 to Kramer; U.S. Pat. No. 4,849,031 of Jul. 18, 1989 to Hauffe et al.; U.S. Pat. No. 4,846,897 of Jul. 11, 1989 to Nakagawa et al.; U.S. Pat. No. 4,812,175 of Mar. 14, 1989 to Reghi; U.S. Pat. No. 4,801,337 of Jan. 31, 1989 to Higgins; U.S. Pat. No. 4,756,805 of Jul. 12, 1988 to Terada et al.; U.S. Pat. No. 4,749,418 of Jun. 7, 1988 to Saeki et al.; U.S. Pat. No. 4,722,753 of Feb. 2, 1988 to Zurilla et al.; U.S. Pat. No. 4,717,431 of Jan. 5, 1988 to Knaster et al.; U.S. Pat. No. 4,673,444 of Jun. 16, 1987 to Saito et al.; U.S. Pat. No. 4,668,305 of May 26, 1987 to Dollman et al.; U.S. Pat. No. 4,650,525 of Mar. 17, 1987 to Yoshida et al.; U.S. Pat. No. 4,617,346 of Mar. 3, 1987 to Prescott; U.S. Pat. No. 4,644,029 of Feb. 17, 1987 to Cable et al.; U.S. Pat. No. 4,643,778 of Feb. 17, 1987 to Donofrio et al.; U.S. Pat. No. 4,637,840 of Jan. 20, 1987 to Fujii et al.; U.S. Pat. No. 4,637,838 of Jan. 20, 1987 to Rausch et al.; U.S. Pat. No. 4,617,068 of Oct. 14, 1986 to King; U.S. Pat. No. 4,596,607 of Jun. 24, 1986 to Huff et al.; U.S. Pat. No. 4,595,424 of Jun. 17, 1986 to Hacias; U.S. Pat. No. 4,565,585 of Jun. 21, 1986 to Matsuda; U.S. Pat. No. 4,559,087 of Dec. 17, 1985 to Jörns et al; U.S. Pat. No. 4,509,992 of Apr. 9, 1985 to Higgins; U.S. Pat. No. 4,498,935 of Feb. 12, 1985 to Kent et al.; U.S.

Pat. No. 4,496,404 of Jan. 29, 1985 to King; U.S. Pat. No. 4,486,241 of Dec. 4, 1984 to Donofrio; U.S. Pat. No. 4,475,957 of Oct. 9, 1984 to Sander; U.S. Pat. No. 4,433,015 of Feb. 21, 1984 to Lindert; U.S. Pat. No. 4,419,199 of Dec. 6, 1983 to Hauffe et al.; U.S. Pat. No. 4,419,147 of Dec. 6, 1983 to Murakami et al.; U.S. Pat. No. 4,416,705 of Nov. 22, 1983 to Siemund et al.; U.S. Pat. No. 4,389,260 of Jun. 21, 1983 to Hauffe et al.; U.S. Pat. No. 4,385,096 of May 24, 1983 to Wetzel; U.S. Pat. No. 4,281,203 of Apr. 26, 1983 to Reinhold; U.S. Pat. No. 4,370,177 of Jan. 25, 1983 to Frelin et al.; U.S. Pat. No. 4,341,558 of Jul. 27, 1982 to Yashiro et al.; U.S. Pat. No. 4,339,310 of Jul. 13, 1982 to Oda et al.; U.S. Pat. No. 4,338,141 of Jul. 6, 1982 to Senzaki et al.; U.S. Pat. No. 4,338,140 of Jul. 6, 1982 to Reghi; U.S. Pat. No. 4,316,751 of Feb. 23, 1982 to Prescott et al.; U.S. Pat. No. 4,313,769 of Feb. 2, 1982 to Frelin et al.; U.S. Pat. No. 4,311,535 of Jan. 19, 1982 to Yasuhara et al.; U.S. Pat. No. 4,306,917 of Dec. 22, 1981 to Oda et al.; U.S. Pat. No. 4,295,899 of Oct. 20, 1981 to Oppen; U.S. Pat. No. 4,292,096 of Sep. 29, 1981 to Murakami et al.; U.S. Pat. No. 4,287,004 of Sep. 1, 1981 to Murakami et al.; U.S. Pat. No. 4,278,477 of Jul. 14, 1981 to Reinhold; U.S. Pat. No. 4,273,592 of Jun. 16, 1981 to Kelly; U.S. Pat. No. 4,264,378 of Apr. 28, 1981 to Oppen et al.; U.S. Pat. No. 4,220,486 of Sep. 2, 1980 to Matsushima et al.; U.S. Pat. No. 4,191,596 of Mar. 4, 1980 to Dollman et al.; U.S. Pat. No. 4,183,772 of Jun. 15, 1980 to Davis; U.S. Pat. No. 4,174,980 of Nov. 20, 1979 to Howell, Jr. et al.; U.S. Pat. No. 4,169,741 of Oct. 2, 1979 to Lampatzer et al.; U.S. Pat. No. 4,163,679 of Aug. 7, 1979 to Nagae et al.; U.S. Pat. No. 4,153,479 of May 8, 1979 to Ayano et al.; U.S. Pat. No. 4,149,909 of Apr. 17, 1979 to Hamilton; U.S. Pat. No. 4,148,670 of Apr. 10, 1979 to Kelly; U.S. Pat. No. 4,146,410 of Mar. 27, 1979 to Reinhold; U.S. Pat. No. 4,142,917 of Mar. 6, 1979 to Yashiro et al.; U.S. Pat. No. 4,136,073 of Jan. 25, 1979 to Mori et al.; U.S. Pat. No. 4,131,489 of Dec. 26, 1978 to Newhard, Jr.; U.S. Pat. No. 4,108,690 of Aug. 22, 1978 to Heller; U.S. Pat. No. 4,101,339 of Jul. 18, 1978 to Kaneko et al.; U.S. Pat. No. 4,063,968 of Dec. 20, 1977 to Matsushima et al.; U.S. Pat. No. 4,059,452 of Nov. 22, 1977 to Nishijima et al.; U.S. Pat. No. 4,054,466 of Oct. 18, 1977 to King et al.; U.S. Pat. No. 4,017,334 of Apr. 12, 1977 to Matsushima et al.; U.S. Pat. No. 3,989,550 of Nov. 2, 1976 to Newhard; U.S. Pat. No. 3,964,936 of Jun. 22, 1976 to Das; U.S. Pat. No. 3,912,458 of Oct. 4, 1975 to Faigen; U.S. Pat. No. 3,879,237 of Apr. 22, 1975 to Faigen; U.S. Pat. No. 3,876,435 of Apr. 8, 1975 to Dollman; U.S. Pat. No. 3,860,455 of Jan. 14, 1975 to Hansen et al.; U.S. Pat. No. 3,850,700 of Nov. 26, 1974 to Heller; U.S. Pat. No. 3,839,099 of Oct. 1, 1974 to Jones; U.S. Pat. No. 3,819,424 of Jun. 25, 1974 to Russell et al.; U.S. Pat. No. 3,819,422 of Jun. 25, 1974 to Schneider; U.S. Pat. No. 3,819,385 of Jun. 25, 1974 to Schumichen et al.; U.S. Pat. No. 3,759,549 of Mar. 6, 1974 to Matsushi-ma et al.; U.S. Pat. No. 3,758,349 of Sep. 11, 1973 to Engesser; U.S. Pat. No. 3,723,334 of Mar. 27, 1973 to Maurer; U.S. Pat. No. 3,723,192 of Mar. 27, 1973 to Obi et al.; U.S. Pat. No. 3,706,604 of Dec. 19, 1972 to Paxton; U.S. Pat. No. 3,697,332 of Oct. 10, 1972 to Kuehner; U.S. Pat. No. 3,671,332 of Jun. 20, 1972 to Rausch et al.; U.S. Pat. No. 3,660,172 of May 2, 1972 to Otto; U.S. Pat. No. 3,645,797 of Feb. 29, 1972 to Lorin; U.S. Pat. No. 3,632,447 of Jan. 4, 1972 to Albrecht et al.; U.S. Pat. No. 3,625,777 of Dec. 7, 1971 to Okabe et al.; U.S. Pat. No. 3,620,777 of Nov. 16, 1971 to Okabe et al.; U.S. Pat. No. 3,619,300 of Nov. 9, 1971 to Heller et al.; U.S. Pat. No. 3,615,912 of Oct. 26, 1971 to Dittel et al; U.S. Pat. No. 3,615,890 of Oct. 26, 1971 to Montella; U.S. Pat. No. 3,607,453 of Sep. 21, 1971 to Engesser et al; U.S. Pat. No. 3,573,997 of Apr. 6, 1971 to Paxton; U.S. Pat. No. 3,565,699 of Feb. 23, 1971 to Paxton; U.S. Pat. No. 3,547,711 of Dec. 15, 1970 to Ashdown; U.S. Pat. No. 3,544,388 of Dec. 1, 1970 to Russell; U.S. Pat. No. 3,535,168 of Oct. 20, 1970 to Thompson; U.S. Pat. No. 3,533,859 of Oct. 13, 1970 to Engesser et al.; U.S. Pat. No. 3,519,494 of Jul. 7, 1970 to Engesser et al.; U.S. Pat. No. 3,516,875 of Jun. 23, 1970 to Rausch et al; U.S. Pat. No. 3,515,600 of Jun. 2, 1970 to Jones et al.; U.S. Pat. No. 3,505,129 of Apr. 7, 1970 to Burstein et al.; U.S. Pat. No. 3,501,352 of Mar. 17, 1970 to Shah; U.S. Pat. No. 3,493,441 of Feb. 3, 1970 to Rausch et al.; U.S. Pat. No. 3,493,440 of Feb. 3, 1970 to Ashdown; U.S. Pat. No. 3,484,304 of Dec. 16, 1969 to Beach; U.S. Pat. No. 3,468,724 of Sep. 23, 1969 to Reinhold; U.S. Pat. No. 3,467,589 of Sep. 16, 1969 to Rausch et al.; U.S. Pat. No. 3,462,319 of Aug. 19, 1969 to Campbell; U.S. Pat. No. 3,459,604 of Aug. 5, 1969 to Freeman et al.; U.S. Pat. No. 3,454,483 of Jul. 8, 1969 to Freeman; U.S. Pat. No. 3,450,578 of Jun. 17, 1969 to Siemund et al.; U.S. Pat. No. 3,450,577 of Jun. 17, 1969 to Beach; U.S. Pat. No. 3,449,229 and 3,449,222 of Jun. 10, 1969 to Freeman et al.; U.S. Pat. No. 3,444,007 of May 13, 1969 to Maurer et al.; U.S. Pat. No. 3,425,947 of Feb. 4, 1969 to Rausch et al.; U.S. Pat. No. 3,404,046 and 3,404,044 of Oct. 1, 1968 to Russell et al.; U.S. Pat. No. 3,404,043 of Oct. 1, 1968 to Dell; U.S. Pat. No. 3,397,093 of Aug. 13, 1968 to Oswald et al.; U.S. Pat. No. 3,397,092 of Aug. 13, 1968 to Cavanagh; U.S. Pat. No. 3,397,091 and 3,397,090 of Aug. 13, 1968 to Russell et al; U.S. Pat. No. 3,385,738 of May 28, 1968 to Russell; U.S. Pat. No. 3,380,858 of Apr. 30, 1968 to Champaneria et al.; U.S. Pat. No. 3,377,212 of Apr. 9, 1968 to Newhard; U.S. Pat. No. 3,347,713 of Oct. 17, 1967 to Lodeseen et al.; U.S. Pat. No. 3,338,755 of Aug. 29, 1967 to Jenkins et al.; U.S. Pat. No. 3,307,980 of Mar. 7, 1967 to Freeman; U.S. Pat. No. 3,297,493 of Jan. 10, 1967 to Blum et al.; U.S. Pat. No. 3,294,593 of Dec. 27, 1966 to Wyszomirski et al.; U.S. Pat. No. 3,268,367 of Aug. 23, 1966 to Nelson; U.S. Pat. No. 3,240,633 of Mar. 18, 1966 to Gowman et al.; U.S. Pat. No. 3,222,226 of Dec. 7, 1965 to Maurer et al.; U.S. Pat. No. 3,218,200 of Nov. 16, 1965 to Henricks; U.S. Pat. No. 3,210,219 of Oct. 5, 1965 to Jenkins; U.S. Pat. No. 3,202,551 of Aug. 24, 1965 to Gerischer et al.; U.S. Pat. No. 3,197,344 of Jul. 27, 1965 to Paxton; U.S. Pat. No. 3,185,596 of May 25, 1965 to Schiffman; U.S. Pat. No. 3,161,549 of Dec. 15, 1964 to Kallenbach; U.S. Pat. No. 3,154,438 of Oct. 27, 1964 to Keller et al.; U.S. Pat. No. 3,146,113 of Aug. 25, 1964 to Lantoin; U.S. Pat. No. 3,130,086 and 3,130,085 of Apr. 21, 1964 to Otto; U.S. Pat. No. 3,101,286 of Aug. 20, 1963 to Reinhold; U.S. Pat. No. 3,090,710 of May 21, 1963 to Triggle et al.; U.S. Pat. No. 3,046,165 of Jul. 24, 1962 to Halversen et al.; U.S. Pat. No. 3,041,215 of Jun. 26, 1962 to Jenkins et al., 3,007,817 of Nov. 7, 1961 to Cavanagh et al.; U.S. Pat. No. 2,988,465 of Jun. 13, 1961 to Newhard et al.; U.S. Pat. No. 2,979,430 of Apr. 11, 1961 to Keller et al.; U.S. Pat. No. 2,967,791 of Jan. 10, 1961 to Halversen; U.S. Pat. No. 2,955,061 of Oct. 4, 1960 to Jenkins et al.; U.S. Pat. No. 2,928,763 of Mar. 15, 1960 to Russell et al.; U.S. Pat. No. 2,902,390 of Sep. 1, 1959 to Bell; U.S. Pat. No. 2,892,884 of Jun. 23, 1959 to Rausch et al.; U.S. Pat. No. 2,882,189 of Apr. 14, 1959 to Russell et al; U.S. Pat. No. 2,868,682 of Jan. 13, 1959 to Dell; U.S. Pat. No. 2,851,385 of Sep. 9, 1958 to Spruance et al.; U.S. Pat. No. 2,840,498 of Jun. 24, 1958 to Logue et al.; U.S. Pat. No. 2,835,617 of May 20, 1958 to Maurer; U.S. Pat. No. 2,832,707 of Apr. 29, 1958 to Rossteutscher; U.S. Pat. No. 2,825,697 of Mar. 4, 1958 to Carroll et al.; U.S. Pat. No. 2,819,193 of Jan. 7, 1958 to Rausch; U.S. Pat. No.

2,813,814 of Nov. 19, 1957 to Goodspeed et al.; U.S. Pat. No. 2,813,813 of Nov. 19, 1957 to Ley et al.; U.S. Pat. No. 2,813,812 of Nov. 19, 1957 to Somers et al.; U.S. Pat. No. 2,809,138 of Oct. 8, 1957 to Wagner et al.; U.S. Pat. No. 2,805,969 of Sep. 10, 1957 to Goodspeed et al.; U.S. Pat. No. 2,800,421 of Jul. 23, 1957 to Goodspeed et al.; U.S. Pat. No. 2,798,829 of Jul. 9, 1957 to Newhard et al.; U.S. Pat. No. 2,796,370 of Jun. 18, 1957 to Ostrander et al.; U.S. Pat. No. 2,769,737 of Nov. 6, 1956 to Russell; U.S. Pat. No. 2,702,768 of Feb. 22, 1955 to Hyams; U.S. Pat. No. 2,692,840 of Oct. 26, 1954 to Bell; U.S. Pat. No. 2,665,231 of Jan. 5, 1954 to Amundsen et al.; U.S. Pat. No. 2,609,308 of Sep. 2, 1952 to Gibson; U.S. Pat. No. 2,591,479 of Apr. 1, 1952 to Ward; U.S. Pat. No. 2,438,887 of Mar. 30, 1948 to Spruance, Jr.; U.S. Pat. No. 2,298,280 of Oct. 13, 1942 to Clifford et al.; U.S. Pat. No. 2,210,850 of Aug. 6, 1940 to Curtin; U.S. Pat. No. 2,121,574 of Jun. 21, 1938 to Romig; U.S. Pat. No. 2,120,212 of Jun. 7, 1938 to Curtin; U.S. Pat. No. 1,911,537 of May 30, 1933 to Tanner; U.S. Pat. No. 1,895,968 of Jan. 31, 1933 to Curtin et al.; U.S. Pat. No. 1,651,694 of Dec. 6, 1927 to Green et al.; U.S. Pat. No. 1,525,904 of Feb. 10, 1925 to Allen; U.S. Pat. No. 1,291,352 of Jan. 14, 1919 to Allen; U.S. Pat. No. 1,287,605 of Dec. 17, 1918 to Allen; and U.S. Pat. No. 1,248,053 of Nov. 27, 1917 to Allen.

The practice of this invention may be further appreciated by consideration of the following, non-limiting, working examples.

The ingredients in the compositions are given in Table 1. The solution of polymer of substituted vinyl phenol used was made according to the directions of column 11 lines 39–52 of U.S. Pat. No. 4,963,596, except that in the final dilution an amount of orthophosphoric acid equal to a final concentration of 0.3% $H_3PO_4$ was used in addition to the deionized water described in the patent. The solution contained 10% of the solid polymer. This solution is identified below as "Aminomethyl substituted polyvinyl phenol solution". Composition 1 was prepared generally by adding the acidic ingredients to most of the "other deionized water" shown, then dissolving the manganese(II) oxide, which reacts to yield manganese phosphates and water, then adding the solution of the organic film forming component, and finally adding enough deionized water to bring the total parts to 1000. Composition 2 was made by diluting Composition 1 with deionized water in an amount so that Composition 2 contained 20% of each of the ingredients other than water in Composition 1.

TABLE 1

| Ingredient | Concentration in Parts of Ingredient in Composition Number: 1 | 2 |
|---|---|---|
| 60% $H_2TiF_6$ in water | 82 | 16 |
| 75% $H_3PO_4$ in water | 45 | 8.9 |
| Manganese (II) oxide (i.e., MnO) | 24 | 4.8 |
| Aminomethyl substituted polyvinyl phenol solution | 602 | 120 |
| Other deionized water | 347 | 851 |

Conventional rectangular sheet test pieces of Type 2024-T3 aluminum were provided with an initial protective coating by subjecting them to the process steps shown in Table 2 below in the order shown in the Table. Contact between the substrate and the liquid composition used in each operation, except for the drying step, was by immersion. All products identified by trademarks in Table 2 are available commercially from the Henkel Surface Technologies division of Henkel Corp., Madison Heights, Mich.

TABLE 2

| Operation Name | Composition | Process Conditions ° C. | Contact Time, Minutes |
|---|---|---|---|
| Cleaning | 15 grams of RIDOLINE ® 53 Cleaner concentrate per liter of cleaning solution; balance water | 60 | 5 |
| Rinsing | Tap water | 18–23 | 1 |
| Deoxidizing | DEOXIDIZER ™ 6-16 products, used according to manufacturer's directions | 18–23 | 3 |
| Rinsing | Tap water | 18–23 | 1 |
| Chromate Conversion Coating | ALODINE ® 600 products, used according to manufacturer's directions | 18–23 | 3 |
| Rinsing | Deionized water | 18–23 | 1 |
| Drying | Ambient air | 18–23 | 5–20 |

Test substrates prepared in this manner, as long as the coating formed by the above stated process sequence was in place and intact, passed bare salt spray tests for two weeks without evidence of corrosion. However, if the coating was scribed through on, or otherwise mechanically removed from, a portion of the surface, rapid severe pitting of the metal underlying the damaged portions of the coating occurred in salt spray testing.

Substrates for testing in this invention were prepared by scribing through a portion of the coating and/or abrading a portion of the coating with a lofty coated abrasive product (SCOTCH-BRITE™ from Minnesota Mining & Manufacturing Co.), in either instance so as to expose underlying metal on part of the surface of a coated test piece, while leaving most of the initial coating intact. The area(s) of metal thus exposed, along with a zone two to ten millimeters wide of the intact original coating around each damaged area, were covered with a layer of Composition 1 or 2 as specified in Table 1. The layer of liquid Composition 1 or 2 was sufficiently thick to form a substantially level surface over both the areas of the substrate from which the initial coating had been removed and a two to ten centimeters wide overlap zone around these areas. This layer of liquid composition was then dried into place, usually without applying any heat source but simply preserving the coating in place by orienting the coated sample so that the coating would not run off under the influence of natural gravity until the coating had dried by evaporation of a sufficient fraction of its water content. In some instances, however, drying was accelerated and completed within a few minutes by use of a supply of heated air such as that furnished by a hair dryer or similar appliance. In all instances, the resistance to salt spray corrosion after all of the removed and/or damaged areas had been covered was at least as high as that of an undamaged sample with the initially applied coating intact over all of its surface.

The invention claimed is:

1. A process for touching up a surface of an object, said surface comprising (i) at least one first area of an initial protective coating over an underlying metal substrate, in which said first area the initial protective coating retains all the protective qualities that it had when initially applied and (ii) at least one second area which consists of one or both of (ii.1) an area of exposed metal and (ii.2) an area of a covering that provides protective qualities inferior to those provided by the initial protective coating in said first area, said process comprising steps of:

(I) coating at least said second area of said surface to be touched up and a transition zone of said first area adjacent to said second area, said transition zone having a width of at least 0.2 mm with a layer of an aqueous liquid composition comprising water and:

(A) a concentration of a component of fluorometallate anions, each of said anions consisting of: (i) at least four fluorine atoms and (ii) at least one atom of an element selected from the group consisting of titanium, zirconium, hafnium, silicon, aluminum, and boron; and, optionally, one or both of (iii) at least one ionizable hydrogen atom, and (iv) at least one oxygen atom;

(B) a concentration of a component of divalent or tetravalent cations of elements selected from the group consisting of cobalt, magnesium, manganese, zinc, nickel, tin, copper, zirconium, iron, and strontium;

(C) a concentration of a component selected from the group consisting of phosphorus-containing inorganic oxyanions and phosphonate anions; and (D) a concentration of a component of water-soluble and/or -dispersible organic polymers and/or polymer-forming resins; and (II) drying into place on the surface of the object the layer applied in step (I), without intermediate rinsing.

2. A process according to claim 1, wherein, in the liquid composition coated in step (I): the concentration of component (A) is at least about 0.010 moles per kilogram of the total composition (hereinafter usually abbreviated as "M/kg"); the concentration of component (B) in M/kg has a ratio to the concentration of component (A) in M/kg that is at least about 0.20:1.0 but not greater than about 3.1.0; the concentration of component (C) is at least about 0.015 M/kg; and the concentration of component (D) is at least about 0.10% of the total composition.

3. A process according to claim 2, wherein, in the liquid composition coated in step (I): component (A) is selected from fluorotitanate and fluorozirconate anions; the concentration of component (A) is at least about 0.020 M/kg; at least 60% of component (B) is selected from the group consisting of cobalt, nickel, manganese, and magnesium; the concentration of component (B) in M/kg has a ratio to the concentration of component (A) in M/kg that is at least about 0.33:1.0 but not greater than about 2.5:1.0; component (C) is selected from orthophosphate, phosphite, hypophosphite, phosphonate and pyrophosphate anions; the concentration of component (C) is at least about 0.030 M/kg; component (D) is selected from the group consisting of epoxy resins, aminoplast resins, tannins, phenol-Formaldehyde resins, and polymers of vinyl phenols with alkyl- and/or substituted alkyl-aminomethyl substituents on the phenolic rings, said polymers being water soluble or dispersible to an extent of at least 1%; the concentration of component (D) in percent of the total composition has a ratio to the concentration of component (A) in percent of the total composition that is from about 0.5:1.0 to about 3:1.0; and the concentration of component (D) is at least about 0.20% of the total composition.

4. A process according to claim 3, wherein, in the liquid composition coated in step (I): the concentration of component (A) is at least about 0.025 M/kg; component (B) is selected from the group consisting of cobalt, nickel, and manganese; the ratio of the concentration of component (B) in M/kg to the concentration of component (A) in M/kg is at least about 0.33:1.0 but not greater than about 1.6:1.0; the concentration of component (C) is at least about 0.035 M/kg; component (D) is selected from the group consisting of epoxy resins and polymers and copolymers of one or more y-(N—$R^1$—N—$R^2$-aminomethyl)-4-hydroxy-styrenes, where y=2, 3, 5, or 6, $R^1$ represents an alkyl group containing from 1 to 4 carbon atoms, and $R^2$ represents a substituent group conforming to the general formula $H(CHOH)_nCH_2$—, where n is an integer from 1 to 7, said polymers and copolymers of one or more y-(N—$R^1$—N—$R^2$-aminomethyl)-4-hydroxy-syrenes having an average molecular weight within the range from 700 to 70,000; the ratio of the solids content of the organic polymers and polymer-forming resins in percent by weight of the total composition to the solids content of component (A) in percent by weight of the total composition is within a range from about 0.75:1.0 to 1.9:1.0; and the concentration of component (D) is at least about 0.30% of the total composition.

5. A process according to claim 4, wherein, in the liquid composition coated in step (I): the concentration of component (A) is at least about 0.030 M/kg; the ratio of the concentration of component (B) in M/kg to the concentration of component (A) in M/kg is at least about 0.40:1.0 but not greater than about 1.4:1.0; the concentration of component (C) is at least about 0.045 M/kg; component (D) is selected from the group consisting of polymers and copolymers of one or more y-(N—$R^1$—N—$R^2$-aminomethyl)-4-hydroxy-styrenes, where y=2, 3, 5, or 6, $R^1$ represents a methyl group, and $R^2$ represents a substituent group conforming to the general formula $H(CHOH)_nCH_2$—, where n is an integer from 4 to 6, said polymers and copolymers of one or more y-(N—$R^1$—N—$R^2$-aminomethyl)-4-hydroxy-styrenes having an average molecular weight within the range from about 3,000 to about 20,000; and the concentration of component (D) as a percentage of the total composition has a ratio to the concentration of component (A) as a percentage of the total composition that is within a range from about 0.90:1.0 to about 1.6:1.0; and the concentration of component (D) is at least about 0.40% of the total composition.

6. A process according to claim 5, wherein, in the liquid composition coated in step (I): the concentration of component (A) is at least about 0.040 M/kg; the ratio of the concentration of component (B) in M/kg to the concentration of component (A) in M/kg is at least about 0.60:1.0 but not greater than about 1.4:1.0; the concentration of component (C) is at least about 0.050 M/kg; component (D) is selected from the group consisting of polymers and copolymers of one or more y-(N—$R^1$—N—$R^2$-aminomethyl)-4-hydroxy-styrenes, where y=2, 3, 5, or 6, $R^1$ represents a methyl group, and $R^2$ represents a substituent group conforming to the general formula $H(CHOH)_nCH_2$—, where n is an integer from 4 to 6, said polymers and copolymers of one or more y-(N—$R^1$—N—$R^2$-aminomethyl)-4-hydroxy-styrenes having an average molecular weight within the range from about 3,000 to about 20,000; the concentration of component (D) as a percentage of the total composition has a ratio to the concentration of component (A) as a percentage of the total composition that is within a range from about 1.05:1.0 to about 1.5:1.0; and the concentration of component (D) is at least about 0.60% of the total composition.

7. A process according to claim 6, wherein, in the liquid composition coated in step (I): the concentration of component (A) is at least about 0.045 M/kg; the ratio of the concentration of component (B) in M/kg to the concentration of component (A) in M/kg is at least about 0.70:1.0 but not greater than about 1.4:1.0; the concentration of component (C) is at least about 0.055 M/kg; the concentration of component (D) as a percentage of the total composition has a ratio to the concentration of component (A) as a percentage of the total composition that is within a range from about 1.05:1.0 to about 1.5:1.0; and the concentration of component (D) is at least about 0.80% of the total composition.

8. A process according to claim 7, wherein, in the liquid composition coated in step (I): the concentration of component (A) is at least about 0.050 M/kg; the ratio of the concentration of component (B) in M/kg to the concentration of component (A) in M/kg is at least about 0.80:1.0 but not greater than about 1.4:1.0; the concentration of component (C) is at least about 0.060 M/kg; the concentration of component (D) as a percentage of the total composition has a ratio to the concentration of component (A) as a percentage of the total composition that is within a range from about 1.10:1.0 to about 1.5:1.0; and the concentration of component (D) is at least about 1.00% of the total composition.

9. A process according to claim 8, wherein, in the liquid composition coated in step (I): the concentration of component (A) is at least about 0.055 M/kg; the ratio of the concentration of component (B) in M/kg to the concentration of component (A) in M/kg is at least about 0.90:1.0 but not greater than about 1.2:1.0; the concentration of component (C) is at least about 0.064 M/kg; the concentration of component (D) as a percentage of the total composition has a ratio to the concentration of component (A) as a percentage of the total composition that is within a range from about 1.15:1.0 to about 1.3:1.0; and the concentration of component (D) is at least about 1.20% of the total composition.

10. A process according to claim 9, wherein, in the liquid composition coated in step (I): component (A) is fluorotitanate anions; component (B) is divalent manganese ions; component (C) is supplied by addition of orthophosphoric acid to the composition; and there is a pH value from about 2.20 to about 2.70.

11. A process according to claim 10, in which the initial protective coating is a chromate conversion coating.

12. A process according to claim 9, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

13. A process according to claim 8, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

14. A process according to claim 7, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

15. A process according to claim 6, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

16. A process according to claim 5, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

17. A process according to claim 4, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

18. A process according to claim 3, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

19. A process according to claim 2, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

20. A process according to claim 1, in which the initial protective coating is selected from the group consisting of a phosphate conversion coating, a chromate conversion coating, and a conversion coating produced by contacting a more than 50% aluminiferous or a more than 50% zinciferous surface with an acidic treating solution comprising at least one of fluorotitanate and fluorozirconate.

* * * * *